US005603184A

United States Patent [19]

Campbell et al.

[11] Patent Number: 5,603,184

[45] Date of Patent: Feb. 18, 1997

[54] SLIDING DOOR LATCH HAVING SANITARY HOOK

[75] Inventors: Frank J. Campbell, St. Clair Shores, Mich.; Sheila R. Campbell, 22843 Sunnyside, St. Clair Shores, Mich. 48084

[73] Assignee: Sheila R. Campbell, St. Clair Shores, Mich.

[21] Appl. No.: 503,103

[22] Filed: Jul. 17, 1995

Related U.S. Application Data

[63] Continuation-in-part of Ser. No. 261,836, Jun. 17, 1994, abandoned.

[51] Int. Cl.[6] ..... E05B 65/06

[52] U.S. Cl. ..... 49/394; 292/145

[58] Field of Search ..... 49/394; 292/137, 292/145, 146, 147, 175, DIG. 30, DIG. 53, DIG. 63, DIG. 65

[56] References Cited

U.S. PATENT DOCUMENTS

| | | | |
|---|---|---|---|
| 2,411 | 12/1841 | Carey . | |
| 337,746 | 3/1886 | Cutter . | |
| 729,980 | 6/1903 | Vordemfelde . | |
| 813,343 | 2/1906 | Bartlett . | |
| 1,070,865 | 8/1913 | Wiley . | |
| 1,354,646 | 10/1920 | Heintzelman . | |
| 1,487,264 | 3/1924 | Raymer . | |
| 1,670,527 | 5/1928 | Williamson . | |
| 1,920,595 | 8/1933 | Ruegg . | |
| 2,232,865 | 2/1941 | Pizzo . | |
| 2,238,513 | 4/1941 | Ward . | |
| 2,835,524 | 5/1958 | Russell . | |
| 2,904,368 | 9/1959 | Taubman . | |
| 3,121,907 | 2/1964 | Stebbins . | |
| 3,152,818 | 10/1964 | Ivins . | |
| 3,347,581 | 10/1967 | Hann . | |
| 3,536,287 | 10/1970 | Kramer . | |
| 3,799,593 | 3/1974 | Dielman | 292/145 |
| 4,690,445 | 9/1987 | Hartley . | |

FOREIGN PATENT DOCUMENTS

| | | | |
|---|---|---|---|
| 991571 | 6/1951 | France | 292/147 |
| 55756 | 4/1891 | Germany | 292/146 |
| 246027 | 3/1926 | Italy . | |
| 251006 | 4/1926 | United Kingdom . | |
| 654890 | 7/1951 | United Kingdom . | |

*Primary Examiner*—Kenneth J. Dorner
*Assistant Examiner*—Jerry Redman
*Attorney, Agent, or Firm*—Howard & Howard

[57] ABSTRACT

A door latch member (16) is slidably supported on a door (14) between a latched position in which the latch member (16) engages a door frame (12) to prevent the free swinging edge of the door (14) from moving with respect to the frame (12), and an unlatched position in which the latch member (16) is spaced apart from the frame (12) to allow the free swinging edge of the door (14) to move relative to the frame (12). The latch member (16) includes a hook (18) having a "U" shape extending outwardly therefrom in a horizontal plane perpendicular to the door (14), the hook (18) presenting a concave pocket facing the outer swinging edge of the door (14) for receiving a human forearm to move the latch member (16) from the latched position to the unlatched position.

5 Claims, 4 Drawing Sheets

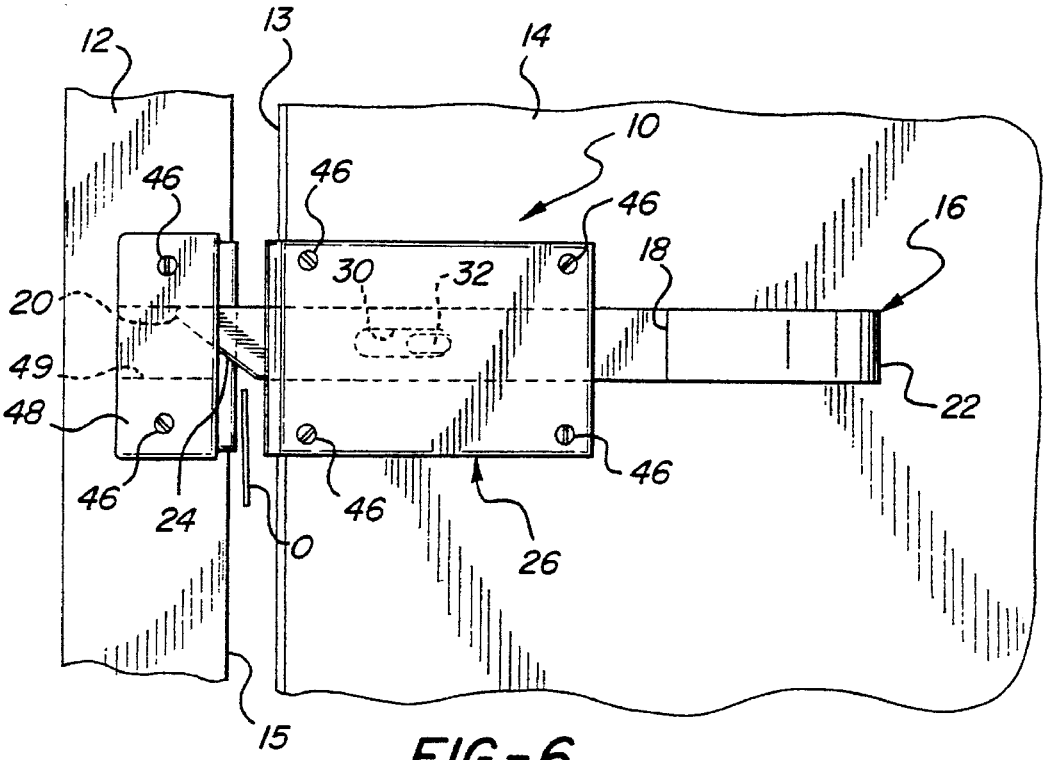
FIG-6
FIG-7
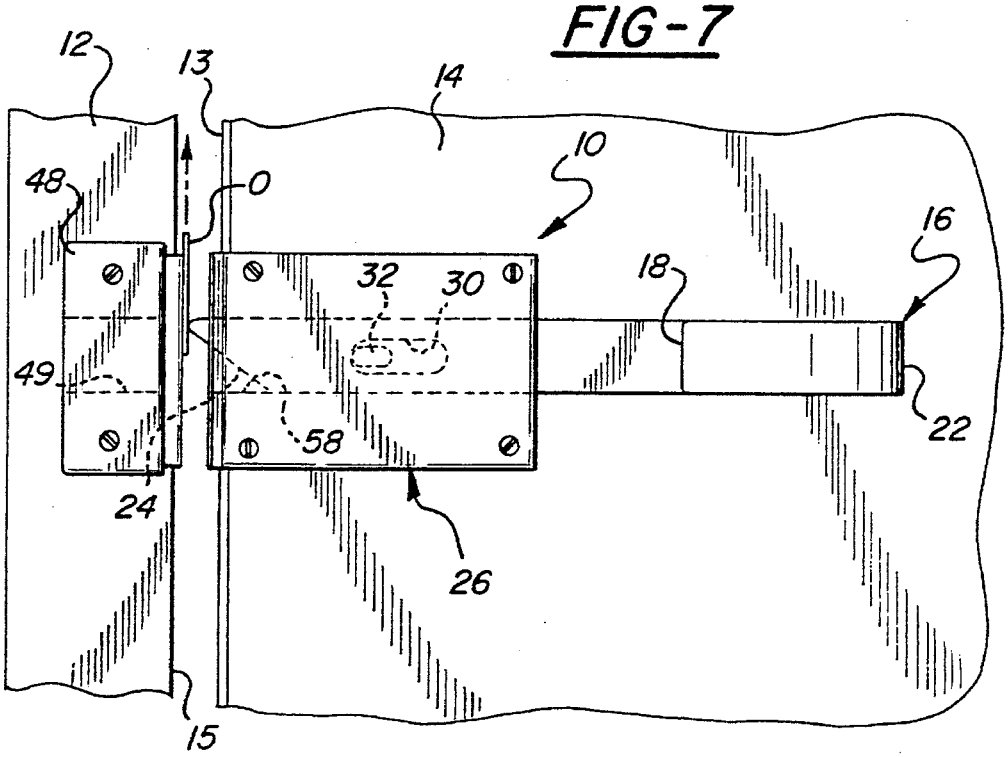

SLIDING DOOR LATCH HAVING SANITARY HOOK

CROSS-REFERENCE TO RELATED APPLICATION

This is a continuation-in-part of application Ser. No. 08/261,836, filed Jun. 17, 1994 now abandoned.

TECHNICAL FIELD

The subject invention relates to door latch assemblies of the type commonly mounted on a door to enable a person to physically engage the latch and thereby latch and unlatch the door.

BACKGROUND OF THE INVENTION

The standard door latch for latching and unlatching a door includes an elongated latch member slidably supported on either a door or a door frame to interconnect the door and the door frame. The latch member includes a handle end having some type of a handle and an oppositely disposed latch end for engaging and disengaging the door frame, etc. Handles of the type hitherto employed on latch mechanisms have generally required a person to use his or her hand to contact the handle and thereby move the latch. This may be inconvenient in the case where the person is handicapped and cannot use his or her hands, or in the case where the person would prefer not to touch the handle with his or her hands for sanitary reasons.

Partition doors in the stall of a public restroom are particularly well suited to receive a sanitary and/or handicapped accessible latch mechanism. In designing and manufacturing equipment to service the handicapped population, however, it is important to consider that handicapped individuals may, from time to time, require emergency assistance inside the restroom stall. For example, a paralyzed person may fall to the floor of the restroom and thus become trapped behind the locked partition door, with outside helpers unable to gain entrance to render assistance. Not only is this situation embarrassing and demeaning to the handicapped individual, but also extremely disheartening to any would be rescuer.

SUMMARY OF THE INVENTION AND ADVANTAGES

The subject invention relates to a door and a sanitary door opener assembly for opening the door. The assembly comprises a door frame defining a door space for receiving the door, a door having an inner edge hinged to the frame and an outer free swinging edge spaced across a gap from the frame, a latch keeper disposed on the frame adjacent the gap, a latch member having an engagement tip and slidable supported on the door adjacent the gap for movement between a latched position in which the engagement tip spans the gap to engage the latch keeper and an unlatched position in which the engagement tip is disengaged from the latch keeper, the latch member including a U-shaped hook presenting a concave pocket facing the outer swinging edge of the door for receiving a human forearm to move the latch member from the latch position to the unlatched position. The improvement of the invention relates to the engagement tip of the latch member including a secondary opener means exposed in the gap when the latch member is in the latched position for moving the latch member to the unlatched position upon receiving a force applied thereagainst by an object inserted within the gap for emergency operation of the latch member.

The subject invention also contemplates a door latch assembly comprising a support bracket, an elongated latch member slidably supported in said support bracket along a imaginary horizontal line between a latched position and an unlatched position, the latch member including an engagement tip extending outwardly from the support bracket and a U-shaped hook spaced therefrom in an imaginary horizontal plane and presenting an open pocket facing in the general direction of the engagement tip to receive a human forearm to force the latch member toward the unlatched position. The improvement of the invention relates to the engagement tip including a secondary opener means extending outwardly from the support bracket when the latch member is in the latched position for moving the latch member to the unlatched position upon receiving a force applied thereagainst by an object for emergency operation of the latch member.

The secondary opener means permits a rescuer to readily open a locked partition door from the exterior by inserting an object, such as a credit card, pocket comb or the like, into the gap between the partition door and the door frame. The credit card or pocket comb may be used by the rescuer to apply a force against the secondary opener means to cause the latch member to slide toward the unlatched position. The rescuer can then open the partition door and assist the individual in need of help. The secondary opener means also provides a convenient method to open a vacant restroom stall which has been locked by mischievous youth.

FIGURES IN THE DRAWINGS

Other advantages of the present invention will be readily appreciated as the same becomes better understood by reference to the following detailed description when considered in connection with the accompanying drawings wherein:

FIG. 6 is a front view of the subject latch assembly disposed on a door in the latched position; and FIG. 7 is a front view as in FIG. 6 showing the latch member moved to the unlatched position by a credit card pulled upwardly in the gap between the door and frame.

DESCRIPTION OF THE PREFERRED EMBODIMENT

Figure 1:
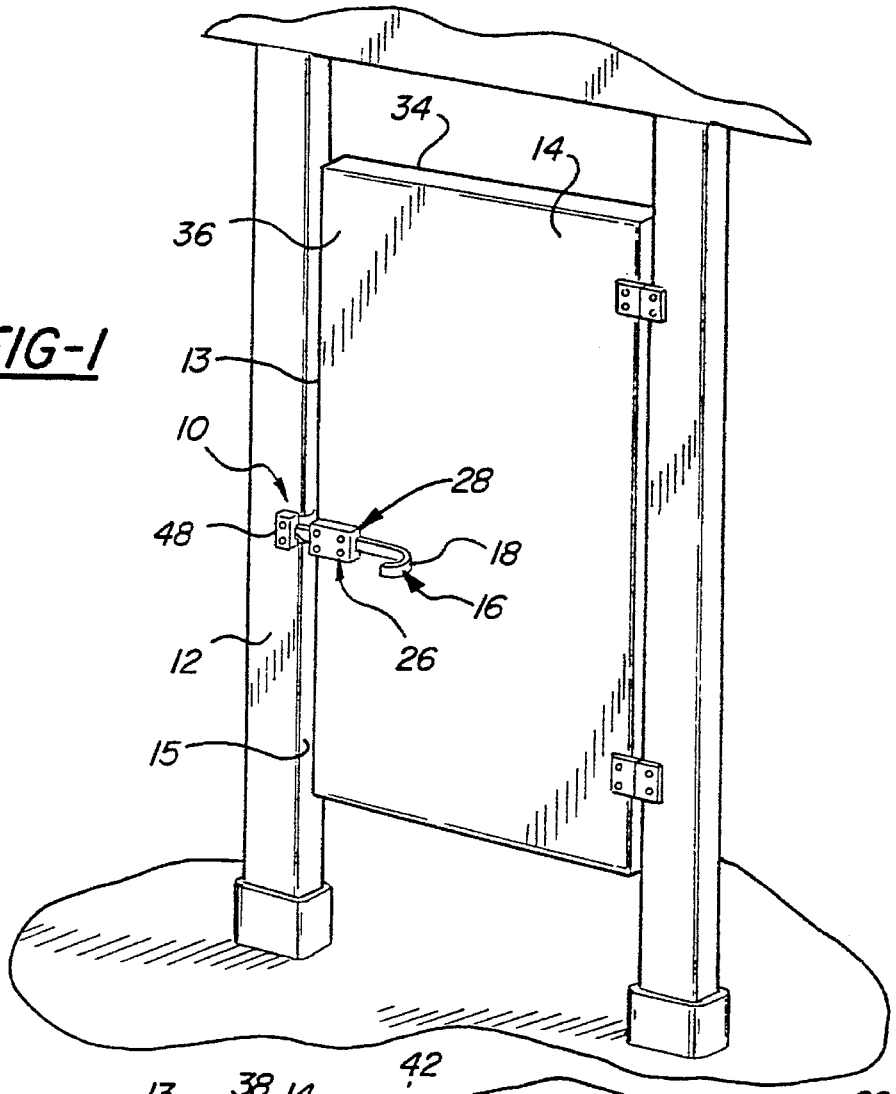
FIG. 1 is a perspective view of the subject latch assembly disposed on the back side of a door.

Referring to the Figures wherein like numerals indicate like or corresponding parts throughout the several views, a door and a sanitary door latch assembly is generally shown at 10.

The assembly 10 comprises a door frame 12 defining a door space for receiving a door, and a door 14 having an inner edge hinged to the frame 12 and an outer free swinging edge 13 spaced across a gap 15 from the frame 12. A latch member generally indicated at 16 is slidably supported on the door 14 along an imaginary horizontal line between a latched position in which the latch member 16 engages the frame 12 to prevent the free swinging edge from moving with respect to the frame 12, and an unlatched position in which the latch member 16 is spaced apart from the frame 12 to allow the free swinging edge of the door 14 to move relative to the frame 12. The assembly 10 is characterized by the latch member 16 including a hook 18 having a "U" shape extending outwardly therefrom in a horizontal plane perpendicular to the door 14, with the hook 18 presenting a concave pocket facing the outer swinging edge of the door 14 for receiving a human forearm to move the latch from the latched position to the unlatched position.

The latch member 16 includes an engagement tip 20 which spans the gap 15 when in the latched position and a handle end 22 spaced apart from the engagement tip 20. The hook 18 is disposed at the handle end 22. Specifically, the handle end 22 of the latch member 16 is curved to form the hook 18. In other words, the hook 18 is part of the handle end 22 of the latch member 16 extending away from the engagement tip 20 a given distance and then curving back around to extend toward the engagement tip 20 to define a "U" shape. Depending on how one looks at the latch member 16, one may also view the hook 18 as defining a "C" or a "J" shape.

The latch member 16 defines a longitudinal axis which extends from the engagement tip 20 toward the handle end 22. The engagement tip 20 of the latch member 16 includes a secondary opener means 24 exposed in the gap 15 when the latch member 16 is in the latched position, best shown in FIG. 6, for moving the latch member 16 to the unlatched position upon receiving a force applied there against by an object O inserted within the gap 15 for emergency operation of the latch member 16. More particularly, the secondary opener means 24 is constructed to permit actuation of the latch member 16 from the opposite side by the insertion of an object O, such as a credit card, pocket comb, or other thin object, into the gap 15.

Figure 2:
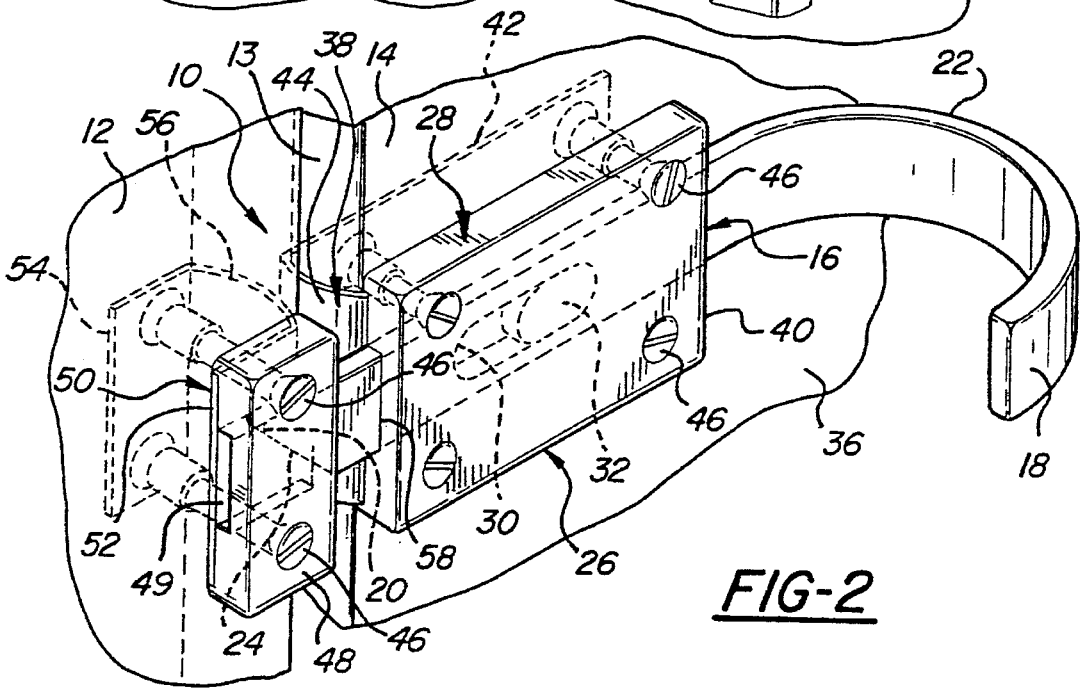
FIG. 2 is an enlarged perspective view of the latch assembly as depicted in FIG. 1 taken from the latch end of the latch member.
Figure 3:
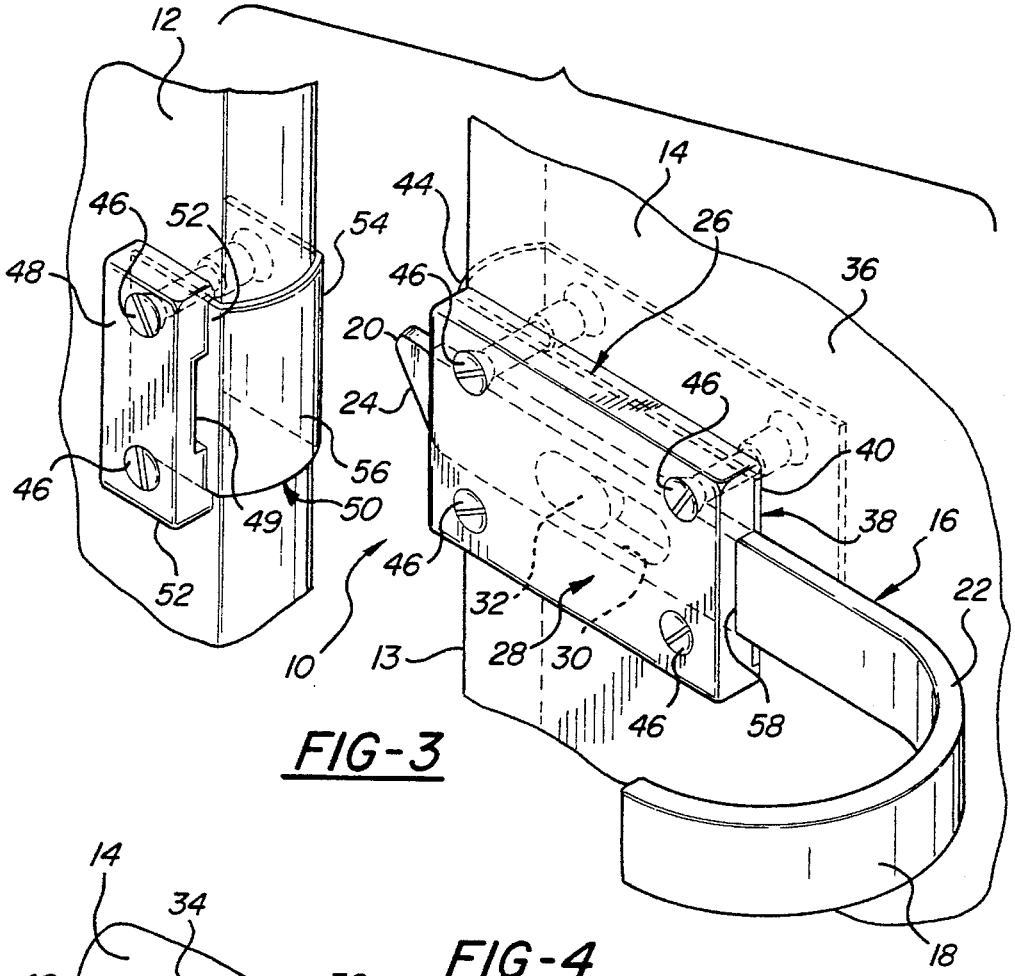
FIG. 3 is an enlarged perspective view of the latch assembly as depicted in FIG. 1 taken from the handle end of the latch member.
Figure 4:
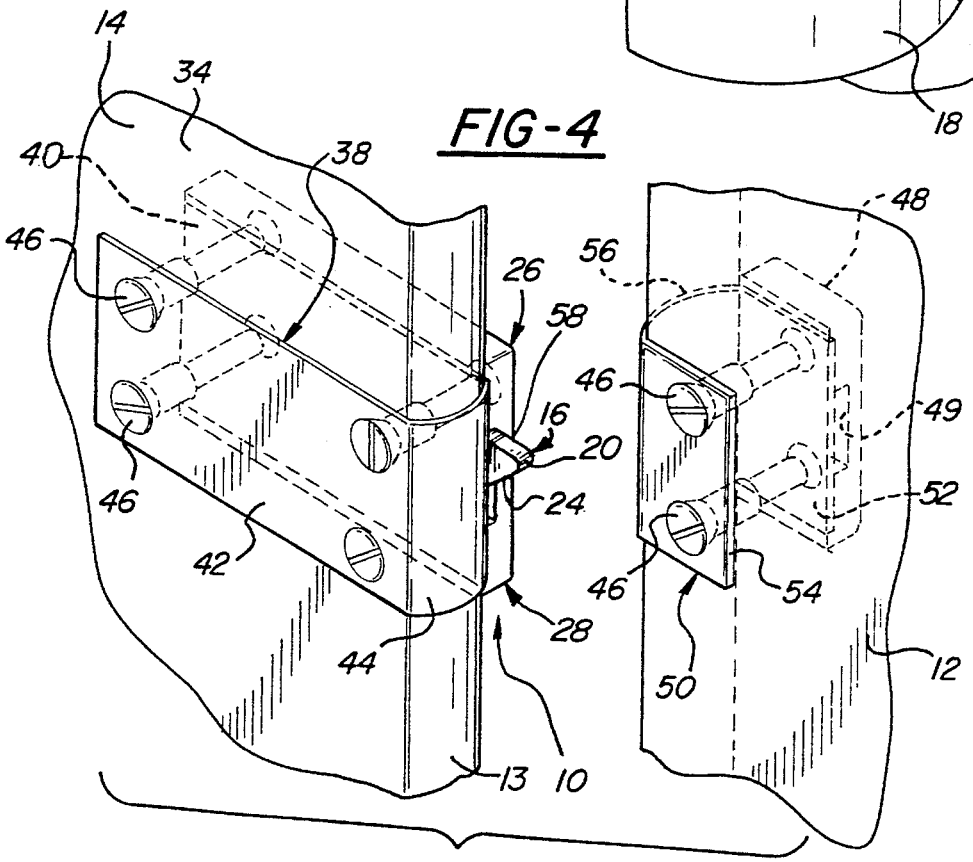
FIG. 4 is an enlarged perspective view of the latch assembly as viewed from the front side of the door and door frame.
Figure 5:
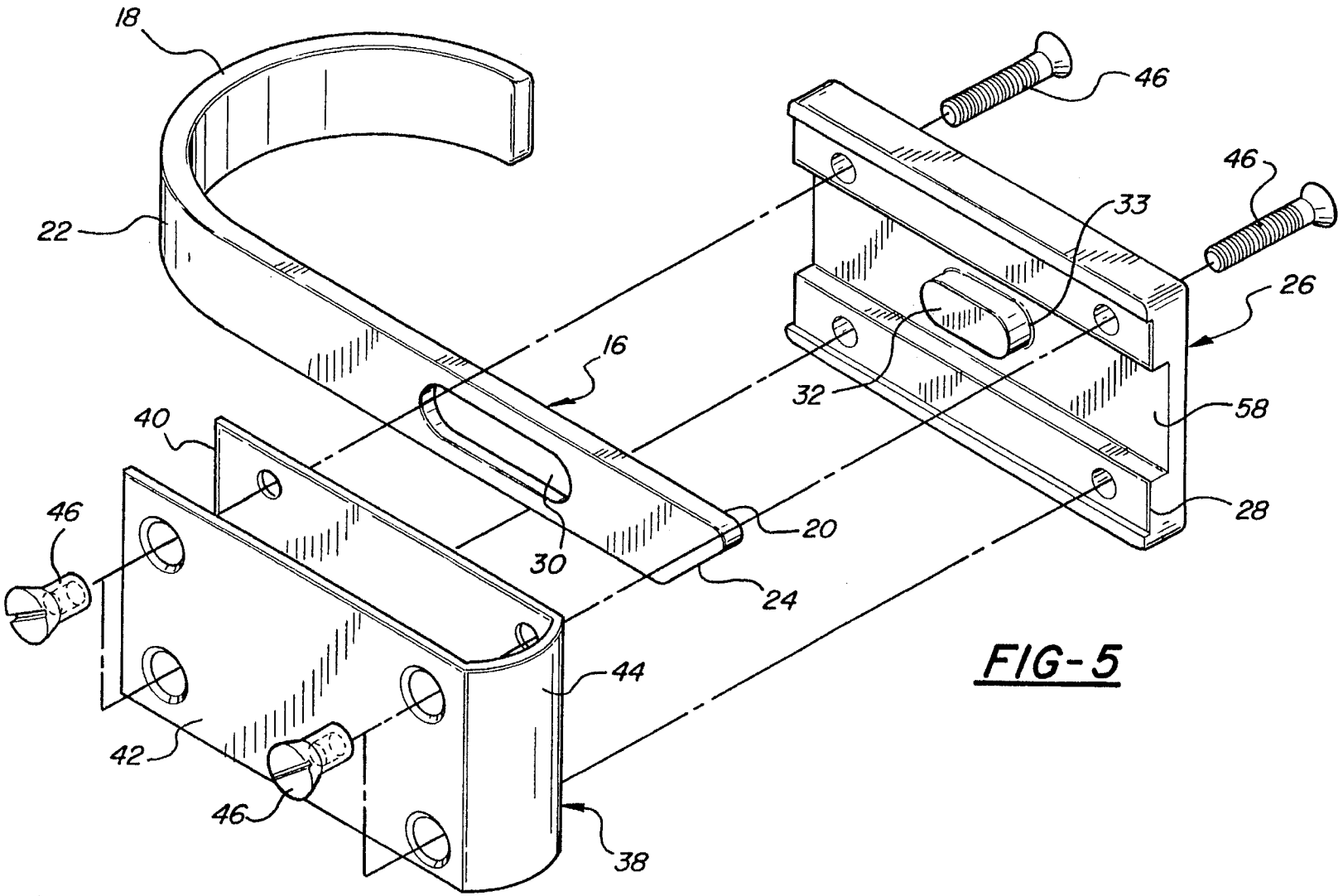
FIG. 5 is an exploded view of the housing, the latch member, and the housing bracket showing the manner in which the latch member is supported in the housing.

As shown in the preferred embodiment of FIGS. 1 through 7, the cam means 24 includes a ramp surface extending from the engagement tip 20 toward the hook 18 at an acute angle. More specifically, the ramp surface is angled in an imaginary plane which intersects the horizontal plane in which the hook 18 lies in an imaginary generally horizontal line which is perpendicular to the direction of sliding movement of the latch member 16 and also perpendicular to the face of the door 14. In the embodiment shown in the Figures, the ramp surface 24 extends from the top side of the latch member 16 at an acute angle toward the bottom side of the latch member 16 where it forms an obtuse angle. However, those skilled in the art will readily appreciate that the ramp surface can be angled in the opposite direction, i.e., forming an obtuse angle relative to the top side of the latch member 16 and an acute angle relative to the bottom side of the latch member 16. Further, those skilled in the art will readily appreciate other and various functionally equivalent embodiments of the secondary opener means 24 in lieu of the smooth angular ramp surface, such as a serrated or stepped edge, a curved edge, or the like.

The assembly 10 further includes a support bracket 26 for retaining the latch member 16 on the door 14 in sliding relationship with the door 14. The support bracket 26 includes a housing 28 mounted on the door 14 slidably supporting the latch member 16, with the housing 28 defining a housing passageway 58 therethrough. The latch member 16 defines a slot 30 extending a predetermined length along the longitudinal axis of the latch member 16. The housing 28 includes a pin or abutment 32 extending into the passageway 58 and through the slot 30. In this way, the latch member 16 will be limited in the extent to which it can reciprocate in the housing 28 between the latched and the unlatched positions. Of course, the situation could be reversed, with the slot disposed through the housing 28 and with the pin extending from the latch member 16 through the slot in the housing 28. The pin or abutment 32 is a piece of plastic or other suitable material. The housing passage 58 defines a cavity 33 into which the piece of plastic 32 fits.

The door 14 includes a front face 34 and a back face 36. The assembly 10 includes a mounting means, generally indicated at 38, which mounts the housing 28 on the back face 36 of the door 14. The mounting means 38 includes a first plate 40 and a spaced apart second plate 42 interconnected with the first plate 40 by a third plate 44. The first, second and third plates 40,42,44 define a "U" shape. As shown in the Figures, the first plate 40 actually forms one of the walls defining the passageway 58. In a similar but slightly different embodiment, the mounting means 38 includes only a single plate which fits into the housing 28 in the manner of plate 40. In this embodiment, there is no plate 42 or 44 which, together with the plate 40, define the "wrap-around" or "U" shape. Appropriate fasteners 46 or adhesive secure the housing bracket to the frame 12.

A latch keeper 48 having a keeper passage 49 for receiving the engagement tip 20 of the latch member 16 is disposed on the frame 12 adjacent gap 15. The engagement tip 20 of the latch member 16 spans the gap 15 and thus engages the keeper 48 when in the latched position to interconnect the door 14 and the door frame 12. The latch keeper 48 includes a latch keeper bracket generally indicated at 50 attaching the latch keeper to the door frame 12. This latch keeper bracket 50, like the mounting means 38 disclosed above for mounting the housing 28, includes a first plate 52 and a spaced apart second plate 54 interconnected with the first plate by a third plate 56. The first, second and third plates 52, 54, 56 define a "U" shape. The first plate 52 actually forms one of the walls of the keeper passageway 49. Appropriate fasteners 46 or adhesive secure the latch keeper 48 to the latch keeper bracket 50 and to the frame 12.

The invention need not include the door 14 and the door frame 12. It may be construed more broadly as a door latch assembly 10 comprising an elongated latch member 16 and a support bracket 26 for slidably supporting the latch member 16 between a latched position in which the latch member 16 interconnects a door 14 and a door frame 12 to latch the door 14, and an unlatched position in which the latch member 16 does not interconnect the door frame 12 and the door 14. The support means 28 includes a first end and a spaced apart second end. The latch member 16 includes engagement tip 20 extending out of the first end of the support means and a handle end 22 extending out of the second end of the support bracket 28. The assembly 10 is characterized by including a hook 18 defining a "U" shape supported on the latch member 16 and extending outwardly therefrom. One might also view the hook 18 as defining a "J" or a "C" shape. In any event, the hook 18 presents an open pocket facing in the general direction of the engagement tip 20 in which a person can place a forearm and force the latch member 16 to the unlatched position.

The support bracket 26 includes a housing 28 defining a passageway 58 therethrough receiving and supporting the latch member 16. The latch member defines a slot 30 therethrough. The housing 28 includes a pin or abutment 32 extending into the passageway 58 through the slot 30. In this way, the latch member 16 will be limited in the extent to which it can reciprocate in the housing 28 between the latched and the unlatched positions. This also is the same retaining arrangement as taught above.

Mounting means 38 mounts the housing 28 onto a door 14. The mounting means 38 includes a first plate 40 and a spaced apart second plate 42 interconnected with the first plate by a third plate 44. The first, second and third plates 40, 42, 44 define a "U" shape. The bracket may also be in the alternative embodiment discussed above where there is only a single plate.

A latch keeper 48 mounts on the frame 12. The latch keeper 48 defines a keeper passageway 49 for receiving the engagement tip 20 of the latch member 16 when the latch member is in the latched position. The engagement tip 20 of the latch keeper 16 thus engages the latch keeper 48 when the latch member 16 is in the latched position. The latch keeper 48 includes a latch keeper bracket 50 for mounting the latch keeper 48 on the frame 12. This latch keeper bracket 50 has been described above.

The subject opener assembly 10 is particularly adapted for attachment to a lockable partition door 14 in a restroom. Not only does the door opener assembly 10 provide sanitary hands-free opening of the partition door 14 for any individual, but is also particularly useful by handicapped individuals due to the large U-shaped hook 18. As many handicapped individuals have limited use of their fingers and hands, the U-shaped hook 18 on the latch member 16 conveniently receives a human forearm to both slide the latch member 16 toward the unlatched position and also to rotate open the partition door 14. Because the concave pocket of the hook 18 faces the outer swinging edge 13 of the door 14, a person's forearm is naturally released from the hook 18 as the door 14 swings open. In this manner, a person's forearm is not trapped in the hook 18 as the door 14 swings open which, of course, would be the case if the concave pocket were to face toward the hinged edge of the door 14.

It is an unfortunate fact of life that sometimes handicapped individuals may require emergency assistance inside a public restroom stall while the latch member 16 of the subject assembly 10 is in the latched position. For example, a paralyzed person may fall to the floor and thus become trapped in the restroom stall, with outside helpers or rescuers unable to gain entrance to the stall because the partition door 14 is locked by the assembly 10. In these instances, the secondary opener means 24 permits a rescuer to conveniently open the partition door from the exterior by inserting a credit card, pocket comb, or other object O into the gap 15 between the partition door 14 and the door frame 12 and thereby move the latch member 16 to the unlatched position to help the unfortunate individual in need of assistance. The secondary opener means 24 is also particularly convenient for janitors or other individuals required to open the locked partition door 14 of an empty restroom stall following the practical joke of mischievous youngsters.

The invention has been described in an illustrative manner, and it is to be understood that the terminology which has been used is intended to be in the nature of words of description rather than of limitation.

Obviously, many modifications and variations of the present invention are possible in light of the above teachings. Therefore, it is to be understood that within the scope of the appended claims the invention may be practiced otherwise than as specifically described. Moreover, the reference numerals are merely for convenience and are not intended to be in any way limiting.

We claim:

1. A partition door and a sanitary door opener assembly (10) for opening said partition door comprising:

a door frame (12) defining a door space for receiving said partition door;

said partition door (14) having an inner edge hinged to said frame (12) and an outer free swinging edge (13) spaced across a gap (15) from said frame (12), said partition door (14) further including a front face (34) and a back face (36);

a latch keeper (48) disposed in said frame (12) adjacent said gap (15);

a latch member (16) having an engagement tip (20) at one end and a U-shaped hook (18) at the other end presenting a concave pocket facing said outer swinging edge (13) of said partition door (14), said U-shaped hook (18) having an inner leg extending to said engagement tip (20) and an outer leg spaced from said inner leg to present an open pocket facing toward said engagement tip (20) with the outer leg being sufficiently co-extensive with a portion of the inner leg for a human forearm to exert a door opening force against the inside of said outer leg of Said U-shaped hook (18) to swing the partition door (14) open;

said engagement tip (20) of said latch member (16) including a ramp surface (24) extending from said engagement tip (20) toward said hook (18);

a surface mounting support bracket (26) for slidably retaining said latch member (16) on said back face (36) of said partition door (14) for allowing sliding movement of said latch member (16) between an unlatched position and a latched position in which said sliding movement of said latch member (16) is limited in said latched position to limit the extension of said ramp (24) from said support bracket (16) so that said engagement tip (20) may be moved to said latched position to overlap said latch keeper (48) supported on the door frame (12) with said ramp surface extending substantially across said gap(15) so that a force may be applied to said ramp surface by an object (O) inserted within said gap (15) in a direction along the length of the gap (15) to move the latch member (16) toward the unlatched position.

2. An assembly (10) as set forth in claim 1 wherein said support bracket (26) includes a housing (28) mounted on said door (14), and a pin (32) extending from one of said housing (28) and said latch member (16), with the other of said housing (28) and said latch member (16) defining a slot (30) for receiving said pin (32).

3. An assembly (10) as set forth in claim 2 wherein said latch keeper (48) includes a keeper passage (49) for receiving said engagement tip (20) of said latch member (16).

4. An assembly (10) as set forth in claim 3 wherein said latch keeper (48) includes a latch keeper bracket (50) for attaching said latch keeper (48) to said frame (12).

5. A door latch assembly (10) for extending across a gap (15) between a closed door (14) and an adjacent door frame (12) to latch the door (14) and prevent swinging movement thereof, said assembly comprising;

a support bracket (26);

an elongated latch member (16) having parallel sides and top and bottom edges to define a rectangular cross section slidably supported by said support bracket, said latch member (16) including an engagement tip (20) at one end and a U-shaped hook (18) at the other end, said U-shaped hook (18) having an inner leg extending to said engagement tip (20) and an outer leg spaced from said inner leg to present an open pocket facing toward said engagement tip (20) with the outer leg being sufficiently co-extensive with a portion of the inner leg for a human forearm to exert a door opening force against the inside of said outer leg of said U-shaped hook (18) to swing the door (14) open;

said engagement tip (20) being defined by a ramp surface (24) extending from said engagement tip (20) at one of said edges at an angle generally in the direction toward said U-shaped hook (18) to an inner end at the intersection with the other of said edges;

a slot (30) and pin (32) interconnecting said support bracket (26) and said latch member (16) for allowing sliding movement of said latch member (16) between a latched position and an unlatched position, said sliding movement of said latch member (16) being limited by said slot (30) and pin (32) in said latched position to limit the extension of the inner end of said ramp surface (24) from said support bracket (16) to a position immediately adjacent to said support bracket (16)whereby said engagement tip (20) may be moved to said latched position to overlap a latch keeper (48) supported on the door frame (12) and spaced by the gap from said support bracket (26) with said ramp surface extending diagonally across a substantial portion of the gap so that a force may be applied to the ramp surface in a direction along the length of the gap to move the latch member (16) toward the unlatched position.

* * * * *